United States Patent [19]

Sherman et al.

[11] 4,129,972

[45] Dec. 19, 1978

[54] TOP VENTED INSULATING STRUCTURE

[75] Inventors: Morton Sherman; James A. Berry, both of St. Petersburg, Fla.

[73] Assignee: The Celotex Corporation, Tampa, Fla.

[21] Appl. No.: 766,649

[22] Filed: Feb. 8, 1977

[51] Int. Cl.[2] ..... E04B 1/70

[52] U.S. Cl. ..... 52/303; 52/404

[58] Field of Search ..... 52/303, 404

[56] References Cited

U.S. PATENT DOCUMENTS

| | | | |
|---|---|---|---|
| 3,313,072 | 4/1967 | Cue | 52/303 |
| 4,019,296 | 4/1977 | Jochmann | 52/747 X |

*Primary Examiner*—J. Karl Bell

*Attorney, Agent, or Firm*—James W. Grace

[57] ABSTRACT

A novel and highly efficient insulating wall structure for a building comprises a generally closed wall with a top venting structure only. The wall structure generally comprises two substantially moisture and air impervious barriers spaced from each other by intervening framing members, a bottom substantially moisture-and-air impervious closure sealing the bottom of said barriers and a venting structure locating only at the top of said wall to release water vapor from the interior of said wall.

15 Claims, 3 Drawing Figures

TOP VENTED INSULATING STRUCTURE

BACKGROUND OF THE INVENTION

1. Field of the Invention

This invention is directed to a novel insulating wall structure for a building.

2. Description of the Prior Art

Generally, in residential construction, a building has insulated walls to inhibit the flow of heat either out of the building in the winter time or into the building in the summer time. This heat insulation factor is of particular importance in these days of high fuel prices and shortages of fuel.

It has been found that as moist air flows from the warmer or hot side to the cooler or cold side of a wall structure and is not arrested at or close to the warmer surface, it could permeate to the dew point location, either within the wall cavity or on the cold surfaces of the wall, and condense into liquid water. Such undesirable situations as paint blistering, staining, siding warping and other mositure related building problems could thus result.

In order to prevent the flow of moisture through the wall, a vapor barrier is usually employed on the warmer or room side of the wall underneath the interior gypsum board and over the framing members. This warm side vapor barrier is generally a sheet with a permeance of less than one perm. It has been recommended that where an outside vapor barrier is also present, the exterior vapor barrier should be from 5 to 10 times as vapor porous as the interior skin. Many sources recommended that cold side ventilation be provided for the escape of moisture which penetrates the wall this exterior vapor barrier is less vapor porous than the interior skin.

Sometimes an additional insulating layer such as fiberboard sheathing will be placed over the outer side of the framing members underneath the exterior siding. This layer of sheathing is very porous and allows moisture to flow out from the wall cavity. However, when this permits moisture to accumulate at the concealed surface of the exterior siding, this thoroughfare of moisture can result in paint blistering, staining, siding warping, and other moisture related problems.

Some prior art recommendations include a cold side ventilation system in which a positive air flow is provided between framing members by installing a ventilating structure at both top and bottom of the wall. In this way, there is an air wash action flowing up and inside the wall cavity. This structure, which has been widely used, also causes a great loss of thermal efficiency by displacing warm moist air from the wall cavity with cold outside air introduced into the wall cavity through the lower vent structure. Under certain conditions, entry of this colder outside air could also cause instances of moisture condensation and freezing in the wall structure.

SUMMARY OF THE INVENTION

This invention if directed to a novel building construction which utilizes a vapor barrier construction on both the inside and outside of a wall with excellent heat insulation characteristics. In addition to the conventional thermal insulation material which is placed between the framing members, the present invention also adds a highly efficient foam plastic thermal insulation board on the outside wall beneath the exterior finishing material. Provision is made for venting of water vapor from the top of the wall cavities only, eliminating the bottom venting of the cavity. The structure can be analogized to a large dimensional bottle in which only the top has an uninsulated opening while the rest of the bottle is relatively heat and moisture impermeable.

It is therefore an object of the present invention to provide a novel wall system in which heat flow is inhibited from flowing through a wall or structure by thermal insulation materials within two spaced moisture impermeable layers.

It is another object of the present invention to provide a novel insulated wall system in which water vapor release takes place through the top of the wall structure only.

Other objects and advantages of the present invention will become apparent to those skilled in the art when the instant disclosure is read in conjunction with the accompanying drawing in which like numerals indicate like elements.

DESCRIPTION OF THE PREFERRED EMBODIMENTS

Figure 1:
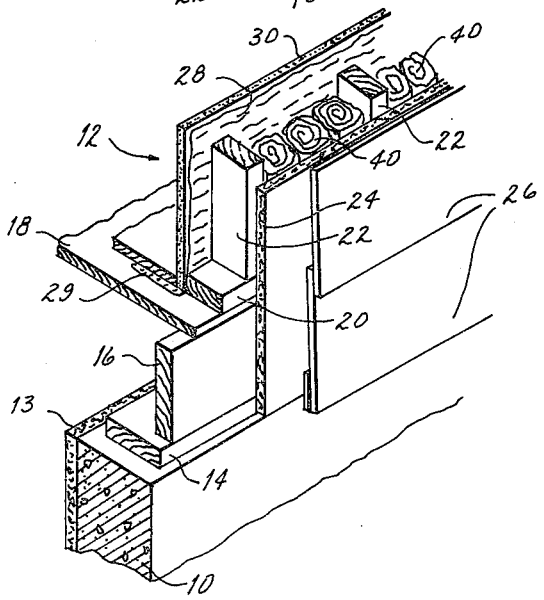
FIG. 1 is a perspective view of a portion of a wall structure illustrating the bottom portion of the wall.

With reference to FIG. 1, there is therein shown a perspective view of the bottom portion of a wall of a building structure. For purposes of this invention, the wall structure shown is typical of residential construction.

In general, there is shown a foundation wall or concrete footing 10 which is poured around the perimeter of the building to support the wall structure 12. A thermal insulating material 13 is attached to the interior of foundation wall 10 to aid in conservation of energy. A sill plate 14 is secured to foundation wall 10 by lag bolts (not shown) which extend upwardly out of the foundation wall 10 to secure the sill plate 14 thereto, and by means of sill plate 14 to hold the wall securely to the foundation 10. A header 16 is secured to sill plate 14 to form a support for subfloor 18 and the wall 12. A plate 20 is secured to subfloor 18 in the conventional manner. Framing members 22 are secured vertically from plate 20 and spaced on conventional 16 inch centers. Framing members 22 are conventionally 2 inch × 4 inch lumber of a height determined by the desired ceiling height from the floor. Metal framing, which would include metal plates or channels and metal studs may also be used, if desired.

On the outside of the framing members 22, a foam plastic thermal insulation board 24 is nailed or otherwise secured as a sheathing to form an insulating layer between the framing members 22 and the outside siding 26. A foam plastic thermal insulation board, with vapor barrier characteristics, i.e., with a permeance of less than 1 perm and thus capable of interfering with the thoroughfare of moisture, is suitable for implementing this invention. The preferred foam plastic thermal insulation board 24 is a product made with a polyurethane or polyisocyanurate foam core with aluminum sheet facers. These facers may be thin aluminum foil adhered to the face of the foam core during the process of manufacture. The aluminum facers can act as heat reflective surfaces and as liquid or gas barriers, since the metal sheets will not permit fluids to penetrate. A suitable foam plastic sheet is one made by The Celotex Corporation of Tampa, Florida under the designation Energy Saving General Purpose Insulation Board (TF-400).

On the outside of sheathing 24 is secured an exterior siding 26 which may be wood, hardboard or other conventional exterior covering for the building. A typical exterior siding may be hardboard siding sold by The Celotex Corporation of Tampa, Florida, under the trademark "Shadowcast". It is a reconstituted wood product made from wood fibers with a suitable binder in a hot press.

On the interior or room side of the structure, a vapor barrier 28 is placed over and secured to the framing members 22. Vapor barrier 28 may be lapped over the subfloor, as shown at 29. Vapor barrier 28 may be a polyethylene sheet with a permeance of less than one perm. A 6 mil thick polyethylene sheet is preferred to thinner gauges because of its greater resistance to accidental puncture and tearing in use. It is also preferred that good workmanship be used in installation of the polyethylene sheet to obtain maximum vapor barrier performance, such as, adequately lapping of adjoining sheets, at window frames, and wall to subfloor and ceiling, enclosure treatment at electrical, plumbing and duct penetrations, and avoiding other similar violations of the barrier layer occurring during the construction process. An interior wall of conventional gypsum wallboard 30 may be secured over the polyethylene vapor barrier. An alternative vapor barrier sheet may be thin aluminum foil laminated to gypsum wallboard or other supporting material.

Glass-fiber batts, preferably the friction-fit type 40, are held in the cavities formed by the framing members 22, the foam plastic sheathing 24 and the interior wall comprised of polyethylene sheet 28 and gypsum wallboard 30. Glass-fiber batts suitable for containment in the wall can be purchased from the Owens-Corning Fiberglas Corporation of Toledo, Ohio who manufacture such batts for use in building structures. As an alternative to glass-fiber batts, granular insulation fill, such as perlite or vermiculite, treated cellulosic fiber, or mineral fiber insulation granules may be contained within the wall cavities. Another alternative insulation material for containment in the wall cavities could be foam plastic material, such as polyurethane, polyisocyanurate, or urea formaldehyde foam.

The techniques of making the wall 12 are well known to contractors and carpenters and, hence, no detailed description of the manner of assembling and building this structure is deemed necessary. The structure is made of conventional materials which are available in the market place and which are conventionally secured by suitable screws, nails, staples, etc.

Figure 2:
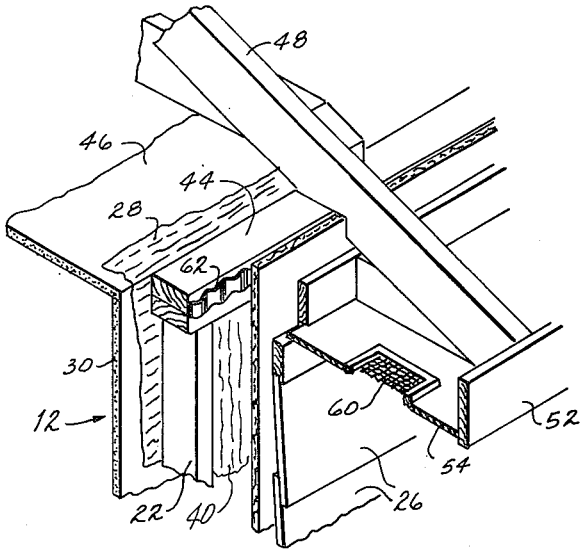
FIG. 2 is a perspective view of a portion of a wall structure illustrating the top portion of the wall and FIG. 3 is a perspective view of a portion of a multistory wall structure illustrating the floor header portion of the wall.

For many conventional residential constructions, the top portion of wall 12 is shown in FIG. 2 in which the elements of FIG. 1 are designated by the same numerals. The top of the cavities formed by the framing members 22, foam plastic thermal insulation board 24 and the combination of the polyethylene sheet 28 and gypsum wallboard 30 is closed by a wall plate 44 which in this case is shown to be two 2 inch × 4 inch pieces of lumber secured together. A ceiling 46 for the room is formed by gypsum wallboard nailed to horizontal framing members (not shown).

A framing member 48, used to support a roof (not shown), is secured to wall plate 44. Fascia 52 and a soffit 54 are attached to form a closure for the building along the edge of the roof. A suitable ventilation area 60 is cut into soffit 54 to provide for sufficient air movement for the removal of moisture from under the roof of the building.

A venting strip 62 is stapled, nailed or otherwise secured to the face of wall plate 44 to permit water vapor release out of the cavities of wall 12. Venting strip 62 is a corrugated rigid plastic strip, nominally 0.030 inches gauge, which may have corrugations on about one-inch centers with a thickness of about one-quarter inch between the crests of adjacent corrugations. Thus, the tops of the corrugations are about ⅛ inch on each side of a center-line through the vent strip. Any suitable rigid plastic material may be used, such as high density polyethylene, polypropylene or polyvinylchloride. It is only necessary that the design of the vent strip 62 provide enough strength so that it does not collapse during wall construction, such as the use of a heavier bead of material at the edges of the vent strip for added resistance to corrugation flattening. Of course, if desired, strip 62 could be made of corrugated metal of suitable thickness.

Figure 3:
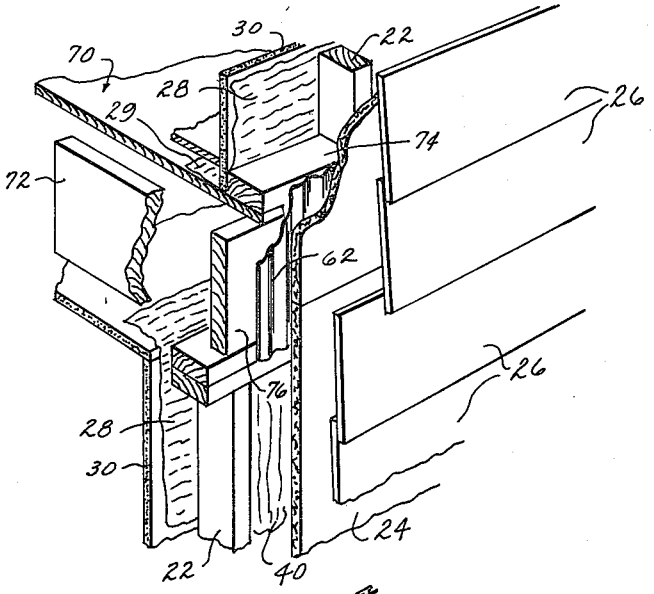

FIG. 3 shows the vent strip when used at an intermediate level in a multi-story building. This structure would be placed between the bottom portion of the wall illustrated in FIG. 1 and the top portion of the wall illustrated in FIG. 2. In this view, a second story is shown and vent strip 62 is much wider than that shown in FIG. 2. In certain instances, the wider vent strip 62 can be replaced with an array of narrower vent strips. In FIG. 3 a horizontal structure 70, which could form the floor structure for a second story, has horizontal framing members 72. Vertical framing members 22 are shown on top of base plate 74 which is attached to second floor header 76. Flooring (not shown) would be secured over horizontal framing members 72. Of course, the framed cavity behind second floor header 76 must also be provided with thermal insulation which is in turn covered by a moisture- and air-impermeable vapor barrier.

It is thus seen that the wall 12 comprises a series of cavities which are relatively moisture impenetrable in all directions but upwardly. The top is kept open to permit moisture release from the cavities utilizing the natural warm-side, upwardconvective flow of warmer moist air to the vent strip at the top plate of the cavity. There is no intentional cold side flow of air from the bottom of the cavities to their tops. In this way a wash of air vertically through the wall is prevented and the insulation effect of the still air in the framed wall is increased. On the other hand, provision is made with this invention, to limit moisture entry into the wall cavities; and yet, also to release what little moisture which may have entered the wall cavity to prevent the accumulation of moisture therein.

In summary, there is described an improved top-venting, insulating structure where all the walls of a cavity are essentially moisture impermeable except for a top venting structure.

We claim:

1. A top-vented, insulating wall in a building structure comprising spaced vertical framing members and interior and exterior face-forming layers, a first substantially moisture- and air-impervious barrier located on one side of said framing members, a second substantially moisture- and air-impervious barrier located on the other side of said framing members, a substantially moisture- and air-impervious closure substantially sealing said barriers at the bottom of said wall and a venting structure located only at the top of said wall to permit release of water vapor from the interior of said wall.

2. A wall as recited in claim 1 in which one of said substantially moisture- and air-impervious barriers is thermal insulation board.

3. A wall as recited in claim 2 in which said thermal insulation board is a plastic foam insulation material.

4. A wall as recited in claim 2 in which said thermal insulation board has a major surface covered with a moisture- and air-impervious sheet.

5. A wall as recited in claim 2 in which both sides of said thermal insulation board are covered with a moisture- and air-impervious sheet.

6. A wall as recited in claim 1 in which one of said moisture- and air-impervious barriers is a flexible sheet.

7. A wall as recited in claim 6 which said flexible sheet is polyethylene.

8. A wall as recited in claim 6 in which said flexible sheet is supported aluminum foil.

9. A wall as recited in claim 1 in which one of said moisture- and air-impervious barriers is foil laminated gypsum wallboard.

10. A wall as recited in claim 1 in which said wall has cavities between said framing members and said cavities are substantially filled with thermal insulation material.

11. A wall as recited in claim 10 wherein said thermal insulation material is thermal insulation granules, mineral fiber thermal insulation, cellulose fill material, foam plastic material, polyurethane foam, polyisocyanurate foam, or urea formaldehyde foam.

12. A wall as recited in claim 1 in which said venting structure comprises a corrugated member located between one of the said substantially moisture- and air-impervious barriers and said framing members.

13. A wall as recited in claim 12 in which said corrugated member is high density polyethylene, polypropylene, rigid polyvinyl chloride or metal.

14. A wall as recited in claim 1 in which said framing members are wood.

15. A wall as recited in claim 1 in which said framing members are metal.

* * * * *